US007264558B2

(12) United States Patent
Kubica

(10) Patent No.: US 7,264,558 B2
(45) Date of Patent: Sep. 4, 2007

(54) GOLF CLUB HEAD WITH FILLER MATERIAL

(75) Inventor: Daniel J. Kubica, deceased, late of Phoenix, AZ (US); by Tania P. Kubica, legal representative, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 201 days.

(21) Appl. No.: 11/103,204

(22) Filed: Apr. 11, 2005

(65) Prior Publication Data

US 2006/0229140 A1 Oct. 12, 2006

(51) Int. Cl.
*A63B 53/04* (2006.01)
*A63B 69/36* (2006.01)

(52) U.S. Cl. ..... 473/326; 473/252; 473/333; 473/340; 473/332

(58) Field of Classification Search ..... 473/324–350, 473/252
See application file for complete search history.

(56) References Cited

U.S. PATENT DOCUMENTS 1,568,888 A * 1/1926 Dunn
1,894,841 A * 1/1933 Adams ..... 473/326
3,387,844 A 6/1968 Shippee
3,516,673 A * 6/1970 Estes ..... 473/256
3,815,910 A 6/1974 Raines
3,817,522 A * 6/1974 Simmons ..... 473/332
3,843,122 A 10/1974 Florian
3,993,314 A * 11/1976 Harrington et al. ..... 473/326
4,113,249 A 9/1978 Beery
4,156,526 A 5/1979 Huggins
4,199,144 A 4/1980 Skelly
4,569,524 A 2/1986 Quijano
4,591,160 A * 5/1986 Piragino ..... 473/326
4,655,458 A * 4/1987 Lewandowski ..... 473/326
4,679,792 A 7/1987 Straza
5,064,197 A * 11/1991 Eddy ..... 473/326
5,083,778 A 1/1992 Douglass
5,178,392 A * 1/1993 Santioni ..... 273/153 R
5,190,290 A 3/1993 Take
5,263,713 A * 11/1993 Taylor et al. ..... 473/326
5,332,214 A 7/1994 Tucker
5,342,052 A * 8/1994 Costa ..... 473/329
5,410,798 A * 5/1995 Lo ..... 29/527.2
5,458,332 A 10/1995 Fisher
5,482,281 A 1/1996 Anderson
5,485,997 A 1/1996 Schmidt (Continued)

FOREIGN PATENT DOCUMENTS

AU 124401 * 5/1947

(Continued)

*Primary Examiner*—Sebastiano Passaniti
(74) *Attorney, Agent, or Firm*—Darrell F. Marquette

(57) ABSTRACT

A golf club head including filler material contained in a bladder disposed in a cavity that is formed in a club head body. A face plate is attached to the body and is arranged for impacting a golf ball. The bladder is located behind the face plate. When the club head strikes a golf ball on the face plate, the filler material dampens vibration which results. In one embodiment, the filler material is compressed air. In other embodiments, the filler material is a gel-like material or a granular material such as sand.

18 Claims, 2 Drawing Sheets

U.S. PATENT DOCUMENTS 5,613,916 A * 3/1997 Sommer ..... 473/332
5,676,606 A 10/1997 Schaeffer et al.
5,788,587 A * 8/1998 Tseng ..... 473/326
5,803,829 A * 9/1998 Hayashi ..... 473/326
5,842,935 A 12/1998 Nelson
7,037,213 B2 * 5/2006 Otoguro ..... 473/333
2006/0128497 A1 * 6/2006 Hou et al. ..... 473/326

FOREIGN PATENT DOCUMENTS

GB 24274 * 10/1899
GB 2 124 910 * 2/1984
GB 2 200 560 * 8/1988
GB 2 247 628 * 3/1992

* cited by examiner

GOLF CLUB HEAD WITH FILLER MATERIAL

BACKGROUND OF THE INVENTION

The present invention relates generally to golf equipment and, in particular, to a golf club head with filler material.

In recent years, golf club heads (and, in particular, golf putter heads) that incorporate inserts made of material different from other portions of the head have gained in popularity. It is believed that such inserts provide golfers with a more desirable "feel" upon striking a golf ball with the club head. Such inserts may provide an improved, and sometimes "soft," feel by dampening unwanted vibration upon contacting the golf ball, which may otherwise travel through the club shaft to the golfer's anatomy. While such inserts have provided a certain modicum of vibration dampening properties, a demand exists for new putter heads having improved vibration dampening properties, without sacrificing other preferred attributes, such as, for example, perimeter and balanced weighting.

U.S. Pat. No. 3,387,844 to Shippee discloses a golf club head having a hollow hermetically scaled percussion chamber formed within it and a resilient face for contacting golf balls. The chamber serves to dampen the movement of the resilient face. The Shippee golf club is described as being useful in creating a unique and desirable sound upon striking a golf ball. The club head may be formed of metal, and the percussion chamber may be formed of plastic or wood.

A golf putter head disclosed in U.S. Pat. No. 3,843,122 to Florian has a core structure containing a lightweight wooden block disposed between a pair of metal castings. The core structure is contained within a plastic shell, and a plastic insert is attached to one side of the shell to form a face for striking a golf ball.

U.S. Pat. No. 4,113,249 to Beery discloses a golf putter head including a front face with a vibratory cover plate mounted on the front face covering a recess formed in the front face. The vibratory cover plate is preferably formed of flexible and resilient material such as plastic so that it cooperates with the recess to provide a resonating chamber in the putter head.

A putter head disclosed in U.S. Pat. No. 4,156,526 to Huggins et al. has a block of resilient material pressed into a cavity defined by back, side and end walls of the head. The block has a striking surface, and it may be removed from the head to permit other blocks of different resiliency to be substituted therefor.

A putter head disclosed in U.S. Pat. No. 4,679,792 to Straza et al. is provided with a face insert formed of a honeycomb cellular structure that has individual cells filled by resilient material such as epoxy resin. Outer exposed ends of the resilient material form a striking face.

U.S. Pat. No. 5,083,778 to Douglass discloses a golf putter head having a rigid body and a resilient laminated face insert formed of inner and outer layers of resilient material. The inner layer of the face insert has a hardness which is less than that of the outer layer of the face insert. Preferably, the outer layer has a hardness which is equal to or greater than the hardness of a golf ball.

U.S. Pat. No. 5,458,332 to Fisher discloses a putter head with an elastomeric pad insert that is formulated to effect a reproducible direct linear relationship between the rebound factor of the pad insert and the distance from the putter head to an intended target.

A putter head disclosed in U.S. Pat. No. 5,485,997 to Schmidt et al. has a face plate insert formed of an elastomer, a synthetic resin or glass. The insert includes a medial portion that has a greater height than its opposite end portions.

SUMMARY OF THE INVENTION

The present invention provides a golf club head including a body having a cavity formed therein. A face plate formed of a material having a first density is attached to the body and is arranged for impacting a golf ball. Filler material contained in the cavity behind the face plate dampens vibration resulting when the club head strikes a golf ball on the face plate. The filler material has a second density that is lower than the first density of the material forming the face plate. The filler material is removable from the cavity and replaceable with another filler material which has a third density that is also lower than the first density but different from the second density.

A bladder may be disposed in the cavity for containing the filler material. A port may be provided in the body for filling the cavity with the filler material, for removing the filler material from the cavity and for refilling the cavity with the another filler material. The filler material may be compressed gas such as air, a semi-solid composition such as a gel-like material or a granular material such as sand.

DESCRIPTION OF THE INVENTION

Figure 1:
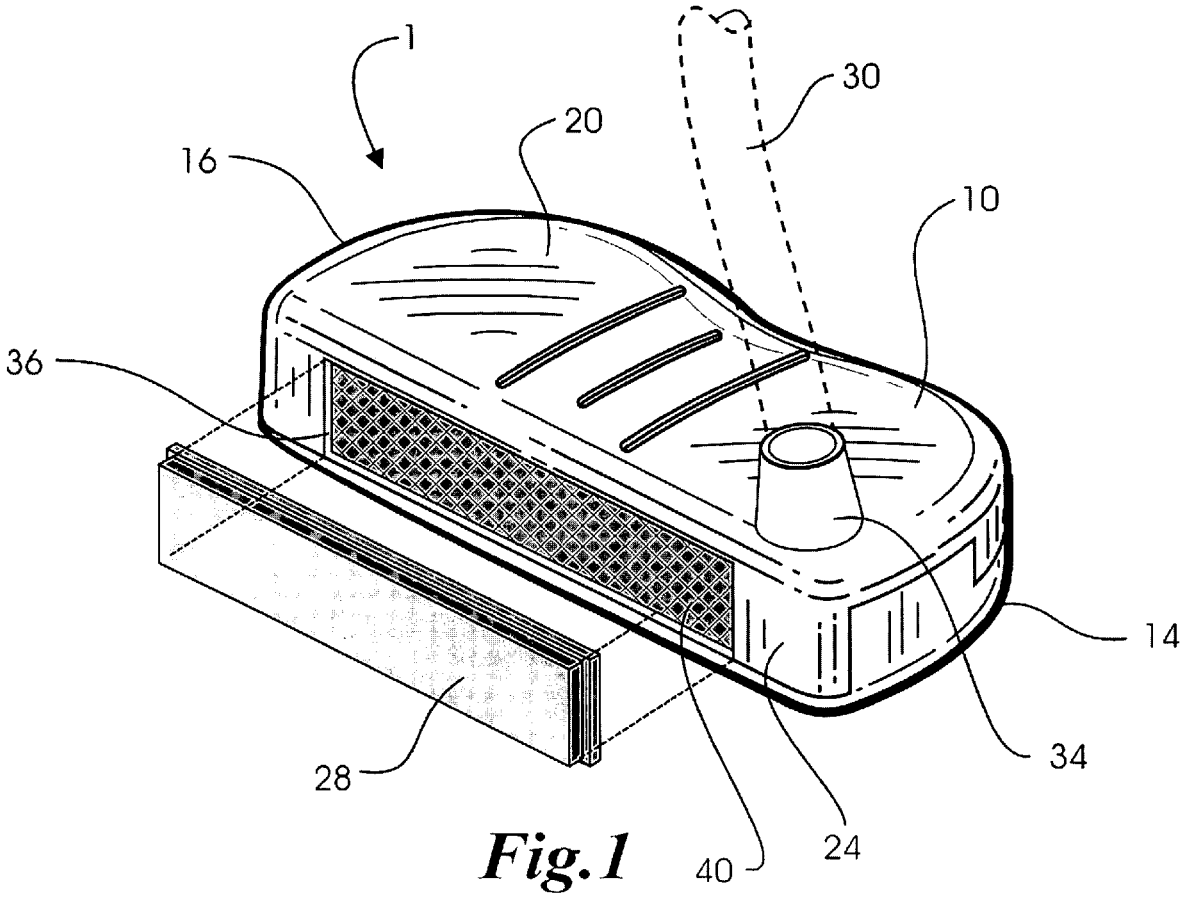
FIG. 1 is a perspective view of a golf club head according to the present invention.
Figure 2:
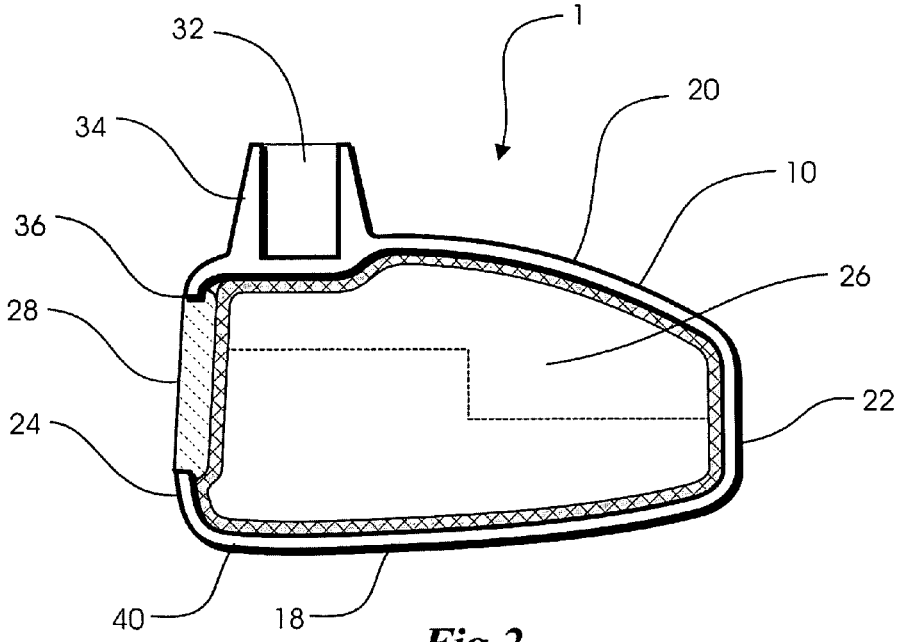
FIG. 2 is a cross-sectional view of the golf club head shown in FIG. 1.

The present invention relates generally to golf club heads, including, for example, putter heads. Referring to FIGS. 1 and 2, a putter head 1, according to the present invention, includes a body 10 having a heel end 14, a toe end 16, a bottom wall 18, a top wall 20, a back wall 22, and a front wall 24. The bottom, top, back and front walls 18, 20, 22 and 24 define a cavity 26 in the body 10. A face plate 28 is attached to the front wall 24 of the body 10. A shaft 30 is received in a bore 32 formed in a hosel 34 that is positioned at the heel end 14 of the body 10.

The body 10 is preferably formed of a suitable material such as steel, titanium, brass, copper, aluminum, composites, and the like. The shape, geometry, and contours of the cavity 26 may vary. In the preferred embodiment, the cavity 26 matches the interior contour of the body 10.

Preferably, the cavity 26 receives filler material for dampening vibration which results when the putter head 1 strikes a golf ball on the face plate 28. The filler material has a density that is substantially lower than the density of the material used to form the face plate 28.

In one embodiment, the mass of the filler material contained within the cavity 26 is less than the total mass of the material used to form the body 10. In another embodiment, the mass of the filler material contained within the cavity 26 is greater than the total mass of the material used to form the body 10. In a further embodiment, the total weight of the filler material is greater than the total weight of the material used to form the body 10, whereas in another embodiment, the filler material has a total weight that is less than the weight of the material forming the body 10.

The specific compositions used to formulate the filler material may vary depending on the attributes that the filler material should preferably exhibit. For example, the composition of the filler material may be designed to achieve certain densities, weights, vibration dampening properties, or other characteristics exhibited by the putter head 1 generally and/or the face plate 28. In certain embodiments, compressed gas may be used as the filler material, wherein the specific gas or gases used may also vary. For example, the invention contemplates that such gas may consist of naturally occurring air; inert gases, such as helium or argon; nitrogen; other gasses; or combinations thereof. Non-limiting examples of inert gases which may be used as filler material in accordance with the present invention include helium, neon, argon, xenon, krypton, and radon. The invention further provides, however, that other gases may be employed as filler material, such as nitrogen, oxygen, or other gases exhibiting desirable properties. In addition, the amount and pressure of gas disposed in the cavity 26 as the filler material may vary depending on the desired level of cavity pressure.

The invention contemplates that different levels of pressure exerted by any given filler material may impart, for example, different weights, vibration absorption characteristics, and effects upon the "feel" of the golf club head. Thus, depending on the desired characteristics of the putter head 1, the pressure within the cavity 26 may be adjusted accordingly by selecting an appropriate filler material and/or compressing the appropriate volume of gas or other substance into the cavity 26.

In certain other embodiments, the filler material consists of a liquid material. In such embodiments, the specific liquid used to formulate the filler material may also vary depending on the desired properties, e.g., weight, density, vibration dampening properties, safety information, cost, and others. Non-limiting examples of liquids which may be used include water, alcohols, organic solvents, or combinations thereof. Still further, the invention contemplates that the filler material may comprise semi-solid characteristics at normal temperatures. That is, compositions known in the art which exhibit, for example, gel-like properties across, preferably, the range of temperatures in which golf is typically played may be used as the filler material.

In still further embodiments, the filler material employed in the present invention may comprise granular material, such as beads, sand, glass or silica particles, or any other mixture of, or homogenous material comprising, a plurality of granules. In such embodiments, the granular filler may further comprise liquids or, alternatively, gas, such as, for example, naturally occurring air.

Figure 3:
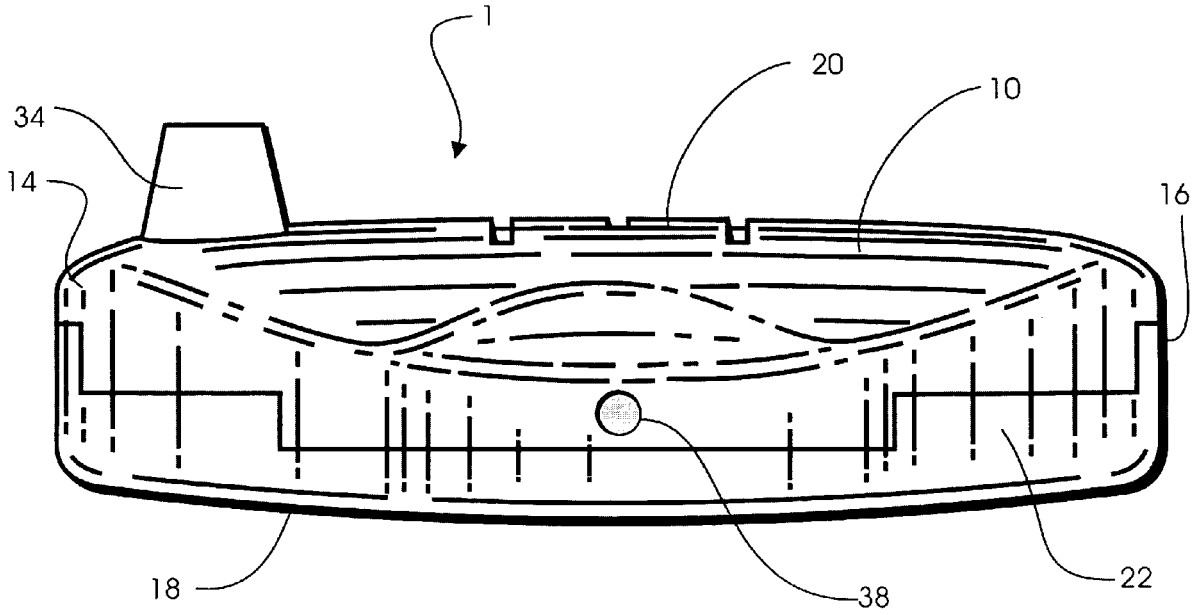
FIG. 3 is a rear elevational view of the golf club head shown in FIG. 1.

The invention is not limited to any particular means for filling the cavity 26 with the filler material. For example, referring to FIG. 3, the invention provides that the body 10 may include a port 38 in back wall 22 for receiving the filler material. In certain embodiments, the body 10 receives the filler material comprising compressed gas through the port 38. The methods used to inject compressed gas into a confined area, such as the cavity 26, are well-known to those skilled in the art. Preferably, after the filler material is received in the cavity 26, the port 38 is closed.

The methods and devices necessary to create a sealable port are well-known to those skilled in the art. For example, the port 38 may be provided with a rubber septum, which may be pierced to inject and/or compress the desired filler material into the cavity 26. Upon removing the device (not shown) for injecting the filler material into the cavity 26, the rubber septum closes to seal off the port 38. After providing the cavity 26 with the filler material in such example, the port 38 may be further sealed using additional materials, such as the material used to construct the body 10.

In other embodiments, however, the invention provides that the port 38 may be opened and resealed. In such cases, the filler material may be periodically replaced, modified, or adjusted with the same composition to maintain or modify, for example, desired vibration absorption characteristics, or, alternatively, replaced with another filler material having a different composition to modify the vibration dampening when the putter head 1 strikes a golf ball on the face plate 28.

In certain embodiments, the putter head 1 is further provided with a bladder 40. In such cases, the filler material is disposed within the one or more bladders 40, which are disposed within the cavity 26. The bladder 40 may be formed from any suitable material capable of holding the desired filler material. The bladder 40, for example, may be substantially flexible or rigid in shape. The body 10 may be formed, molded, or cast around the bladder 40 containing the desired filler material or, in other embodiments, the port 38 may pass through the body 10 and bladder 40 to provide a means for injecting the desired filler material into the cavity 26.

In still other embodiments, the cavity 26 includes a plurality of bladders 40. In such embodiments, it may be desirable to provide the same filler material to each bladder or, alternatively, a different filler material to each bladder. The density, weight, pressure, or other factors relevant to the filler material may be considered in determining the filler material compositions for each bladder in such embodiments. For example, it may be desirable to provide filler materials exhibiting greater weights or densities in the bladders arranged near the toe 16 or heel 14 ends of the body 10, whereas filler materials of less weight and density may be provided in bladders near the approximate center of the body 10. Such embodiments, for example, may be desired to enhance the perimeter-weighting attributes of the putter heads in order to prevent unwanted twisting movement about the vertical axis of such putter heads.

The front wall 24 of the putter head 1, optionally, in one preferred embodiment, comprises the face plate 28, which consists of a material that is optimized for striking a golf ball. In certain embodiments, for example, the face plate 28 is preferably formed of an elastomeric material such as polyurethane or any other material know to those of ordinary skill in the art. In such embodiments, the front wall 24 preferably includes a recess 36 for receiving the face plate 28, which may be affixed within such recess 36 using any suitable means known in the art, such as adhesives, screws, engaging elements to snap the face plate 28 into place, welding means, or any other means of temporarily or permanently bonding the face plate 28 to the front wall 24. In other embodiments, the face plate 28 is moveable within the recess 36.

What is claimed is:

1. A golf putter head comprising:

a generally hollow body having a bottom wall, a top wall, a back wall and a front wall defining a cavity formed therein, said body also having a heel end and a toe end;

a face plate mounted in a recess in the front wall of said body and arranged for impacting a golf ball, said face plate being formed of a material having a first density;

filler material contained in a bladder disposed in said cavity behind said face plate and having a second density that is lower than said first density, said bladder is located between said heel and toe ends of said body;

said filler material dampening vibration resulting when said club head strikes a golf ball on said face plate, said filler material being removable from said cavity and replaceable with another filler material which has a third density that is also lower than said first density but different from said second density;

another bladder located at the heel end of said body, and a further bladder located at the toe end of said body; and said another bladder and said further bladder each containing said another filler material.

2. The golf putter head of claim 1, further comprising a port in the back wall of said body for filling said bladder with said filler material, for removing said filler material from said bladder, and for refilling said bladder with said another filler material.

3. The golf putter head of claim 2, wherein said port may be opened and closed.

4. The golf putter head of claim 1, wherein said filler material comprises compressed gas.

5. The golf putter head of claim 4, wherein said compressed gas is naturally occurring air.

6. The golf putter head of claim 1, wherein said filler material comprises a liquid.

7. The golf putter head of claim 6, wherein said liquid is water.

8. The golf putter head of claim 1, wherein said filler material comprises a semi-solid material.

9. The golf putter head of claim 8, wherein said semi-solid material is a gel-like material.

10. The golf putter head of claim 1, wherein said filler material comprises a granular material.

11. The golf putter head of claim 10, wherein said granular material is sand.

12. A golf putter head comprising:

a generally hollow body having a bottom wall, a top wall, a back wall and a front wall defining a cavity therein, said body also having a heel end and a toe end;

a face plate mounted in a recess in the front wall of said body and arranged for impacting a golf ball;

a bladder disposed in said cavity behind said face plate between said heel and toe ends of said body;

filler material contained in said bladder for dampening vibration resulting when said club head strikes a golf ball on said face plate;

another bladder located at the heel end of said body, and a further bladder located at the toe end of said body; and said another bladder and said further bladder each containing another filler material.

13. The golf putter head of claim 12, wherein said filler material is compressed air.

14. The golf putter head of claim 12, wherein said filler material is a gel-like material.

15. The golf putter head of claim 12, wherein said filler material is granular material.

16. The golf putter head of claim 12, wherein said filler material has a first density, and wherein said another filler material has a second density.

17. The golf putter head of claim 16, wherein said face plate has a third density, and wherein said first and second densities are lower than said third density.

18. The golf puffer head of claim 16, wherein said second density is greater than said first density.

* * * * *